United States Patent [19]

Minoda et al.

[11] 4,154,612

[45] May 15, 1979

[54] METHOD OF MAKING SILVER HALIDE PHOTOGRAPHIC LIGHT-SENSITIVE MATERIALS

[75] Inventors: Minoru Minoda; Masaharu Ogawa, both of Minami-ashigara, Japan

[73] Assignee: Fuji Photo Film Co., Ltd., Minami-ashigara, Japan

[21] Appl. No.: 867,268

[22] Filed: Jan. 5, 1978

Related U.S. Application Data

[63] Continuation of Ser. No. 708,783, Jul. 26, 1976, abandoned.

[30] Foreign Application Priority Data

Jul. 25, 1975 [JP] Japan ..... 50-90852

[51] Int. Cl.[2] ..... G03C 3/00; G03C 1/02; F26B 3/28; H05B 9/06

[52] U.S. Cl. ..... 96/67; 96/94 R; 34/4; 219/10.55 M

[58] Field of Search ..... 96/94 R, 67, 85; 34/1, 34/4, 9; 219/10.55 A, 10.55 M; 427/374 B

[56] References Cited

U.S. PATENT DOCUMENTS

| | | | |
|---|---|---|---|
| 3,584,391 | 6/1971 | Cunningham | 34/9 |
| 3,861,922 | 1/1975 | Minoda | 96/67 |
| 3,884,692 | 5/1975 | Minagawa | 96/85 |

OTHER PUBLICATIONS

Making and Coating Photographic Emulsions ©1964, Zelikman and Levi, Focal Press, N.Y., N.Y., pp. 30–33.

*Primary Examiner*—J. Travis Brown
*Assistant Examiner*—L. Calasco
*Attorney, Agent, or Firm*—Sughrue, Rothwell, Mion, Zinn and Macpeak

[57] ABSTRACT

In making silver halide photographic light-sensitive materials, a method of drying a layer of silver halide emulsion coated on a support is disclosed. The coated film is cooled and set, and thereafter a normal portion of the coated film is dried and undried thickly coated portions of the coated film are then dried by use of microwaves.

5 Claims, 1 Drawing Figure

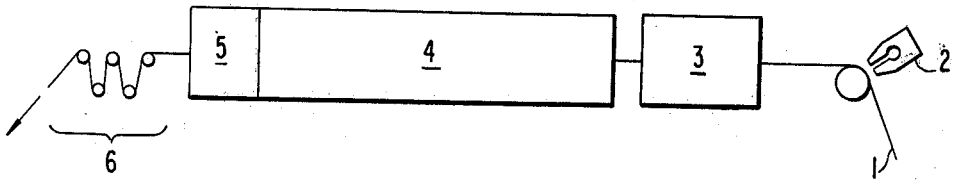
5
4
3
2
6
1

METHOD OF MAKING SILVER HALIDE PHOTOGRAPHIC LIGHT-SENSITIVE MATERIALS

This is a continuation, of application Ser. No. 708,783, filed July 26, 1976 now abandoned.

BACKGROUND OF THE INVENTION

1. Field of the Invention

This invention relates to a process for the preparation of silver halide photographic light-sensitive materials. More particularly, this invention relates to a method of drying a layer of silver halide emulsion(s) coated on a support in the preparation of the silver halide photographic light-sensitive materials.

2. Description of the Prior Art

Generally stated, the preparation of silver halide photographic light-sensitive materials is accomplished by the steps of: preparing a silver halide emulsion(s); adding additives such as film hardeners, coating assistants and the like thereto; coating the same on a flexible lengthy support (hereinafter referred to as a "web"); cooling, setting, drying and further humidifying the same. In this case, more than two layers of silver halide emulsions are often coated, and, in addition, such emulsions are sometimes coated along with an auxiliary layer such as a protective layer or a backing layer.

The customary manner of drying the layers of silver halide emulsions on the support as described above has been to blow air at a temperature of from 20° to 40° C. and at a relative humidity of from 15 to 60% against the silver halide emulsion(s) layer(s) on the web at an air velocity of 15 to 30 m/sec so as to dry them as slowly as possible (hereinafter referred to as "air drying"). While other gases could be used, on a commercial scale air is the universal choice. The air drying is usually completed in about 3 to about 10 minutes.

These conditions are usually utilized for the initial drying step of the present invention, but the initial drying step of the present invention, but the initial drying step is completed shorter than the air drying of the prior art, usually about 50% to about 70% of the prior art.

In the step of making silver halide photographic materials, it is advantageous to carry out coating in a continuous manner, and, therefore, coating is usually carried out without interruptions by supplying a web, which is in the form of a butt-joined strip obtained by successively splicing limited lengths of webs to each other by butt-splicing or the like, to a coating station. It appears, however, that when a coating liquid having fluidity is applied to such spliced portions of a web by a continuous operation, several significant defects occur, principally downstream of the spliced portions. One defect is that air bubbles are introduced between the web surface and the coating layer directly after spliced portions, and air bubbles adhere to a coating nozzle, resulting in undesirable phenomena such as longitudinal stripes on the film surface coated over a considerable length. Another defect is that because of the occurrence of step-wise discontinuous variations at the trailing edge of the joining tape at the spliced portion (and due to the presence of the aforesaid air bubbles), the film coated on the web surface forms uncoated air bubbles), the film coated on the web surface forms uncoated portions, excessively thinly coated portions and locally thickly coated portions directly after the spliced portions of the web.

It appears that such thickly coated portion can occur not only in portions close to the aforesaid spliced portion of the web but also in those portions in the vicinity of discontinuities such as projections or ridges on the web surface, if so present, and coat-start portions and side end portions of the film (hereinafter referred to as "lugs" as a shorthand form of identifying the lateral edge portons of the web). The thickly coated amount in these areas is about 200 to about 250% of the normal coating amount in the vicinity of the splice portion, about 150 to about 300% in the coat-start portion, and about 120 to about 200% in the lugs. Even with an efficient coating operation, the lugs often extend about 3 to about 7 mm in from each side of the web (in the lateral direction), the coat-start portion (or coating start up portion) is about 5 to 20 mm along the travelling direction of the web and at the splices about 5 to about 20 mm along the travelling direction of the web will be thickly coated. As one skilled in the art will appreciate, normal coating amounts vary widely depending upon the kind of emulsion involved, and, therefore, there is no unequivocal definiation for the normal coating amount. Quite often, however, on commercial scale, normal coating amounts re less than about 40 $\mu$ in the dry state and about 5 to about 400 $\mu$ in the wet state.

Such thickly coated areas require much more time to dry than is required for drying normal areas, and, in the event that the drying is not sufficient, such thickly coated areas reach the humidifying step without being dried, and undried coating liquids are transferred to rollers or the like to contaminate the same and to harm films properly coated, resulting in product defects.

In the past, therefore, drying equipment has been provided, which is sufficient to dry the thickly coated areas, to avoid the defects noted above. However, such thickly coated areas do not yield acceptable finished products and will be thrown away, and, thus, the device for drying these thickly coated areas could be inherently be dispensed with. Moreover, usually the room required for the drying equipment which is used to dry these thickly coated areas occupies 30 to 50% of the entire production facility, thus, posing an uneconomical problem in terms of space utilization. Further, recent trends towards higher production tend to increase coating speeds; one way to accomplish this is to decrease the drying load involved, but there is a limit as to how far one can decrease the amount of coated material or increase the coating solution viscosity in order to decrease the drying load in order to decrease the amount of moisture which is to be removed by evaporation. Hence, the space occupied by drying equipment tends to inevitably increase, and, as a consequence, the aforesaid disadvantages become more pronounced.

SUMMARY OF THE INVENTION

It is, therefore, one object of the present invention to provide a method of rapidly drying thickly coated areas in film of silver halide emulsions in preparing silver halide photographic materials which does not require great space.

This and other objects of this invention are accomplished by drying normal thickness areas by air drying, after which undried thickly coated areas of film are dried by microwaves.

The microwaves used herein have frequencies in the range of from 300 to 3,000 MHz.

It should be noted that a method of coating in accordance with the present invention can be applied to bead coating (see U.S. Pat. No. 2,761,791 and others), extrusion coating (see U.S. Pat. No. 3,526,528 and others), curtain coating (see U.S. Pat. Nos. 3,508,947, 3,632,374 and others), and all other coating methods heretofore used for coating photographic light-sensitive materials such as roller coating, air knife coating and the like.

BREIF DESCRIPTION OF THE DRAWINGS

A preferred embodiment of the present invention will be described by reference to the attached drawing which is a flow sheet of the steps of coating, drying and humidifying illustrating one embodiment in accordance with the present invention.

DESCRIPTION OF THE PREFERRED EMBODIMENTS

Referring now to the FIGURE, which is a flow sheet showing an embodiment of the invention, web 1 fed by a feed roll (not shown) is coated by a conventional coating device 2 with one or more silver halide emulsions. Web 1 thus coated with the one or more silver halide emulsions is passed to setting device 3, where the former is cooled and set by blowing air at temperatures of 2° to 5° C. and having a dew point of −10° to 0° C. against the film at a velocity of 2 to 5 m/sec, after which the web 1 is fed to drier 4. In drier 4, air at a temperature of 20° to 40° C. and at a relative humidity of 15 to 60% is blown against the film surface on the web 1 at a velocity of 15 to 30 m/sec to dry the coated film. Drier 4 is designed to dry normally coated areas of the coated film so as to completely dry the normal areas, but need not possess a drying capability sufficient to dry a thickly coated areas. Web 1, which has normally coated areas thereof dried, is then passed to microwave drier 5, where thickly coated areas of the film are dried.

Generally, microwave drying is capable of providing a very rapid drying so that the thickly coated areas of the film can be completely dried by use of a very small device as compared to prior art devices. According to one aspect of microwave drying, moreover, microwave energy is selectively absorbed in areas having a higher coating load, that is, in areas having a higher water content, so that energy losses are minimized, and, in addition, film quality in normal thickness areas of coated film is not injured. Such a feature is in great contrast to previous beliefs that if a layer of silver halide emulsions is quickly dried by infrared drying or the like, fog would be produced or the strength of film adversely affected.

As the microwave drier 5, various types of microwave heters may be utilized such as, for example, an oven type drier as is used for electronic ranges or the like, a zig-zag waveguide-tube type drier as is disclosed in U.S. Pat. No. 3,672,066, and a fringing field type drier as is disclosed in U.S. Pat. No. 3,558,840, but the oven type drier, which is simple in construction, is well situated for this purpose because uniform heating is not required in the process of the present invention.

Since the microwave drier is used for drying thickly coated areas it need not be actuated when no thickly coated areas are present. Therefore, in the event that areas which are always coated thickly, such as lugs, are removed by improvements in the coating method itself, it is preferred to employ a system wherein the thickly coated areas are pre-sensed to send an actuating signal to the microwave drier so that the drier 5 is actuated only when thickly coated areas pass therethrough.

Web 1, of which thickly coated areas are dried in the microwave drier 5, is moved to a humidifying device 6, where the water content of the coated film is controlled at a temperature of 20° to 25° C. and a relative humidity of 55 to 70% before being fed to the subsequent steps of the process, for example, a winding step.

It is to be understood that the present invention is not limited to the foregoing embodiments, and various modifications may be made therein. For example, where thick lugs are present, the microwave drier 5 must always be operated, whereas, where thick lugs are not present, spliced portions except for coat-start portion usually pass through the microwave drier 5 at regular time intervals so that the microwave drier 5 may also be designed so as to be actuated at regular time intervals.

In addition, air may also be used in the microwave drier 5, that is, air can be blown against the boundary layer of air of high humidity at the film surface formed by microwave irradiation to blow it away, thereby increasing the driving force of microwave drying to enchance the drying effect as well as permitting the microwave drying step apparatus to be more compact.

The present invention affords novel effects as follows:

(1) Since thickly coated areas of film are dried by microwave drying of good drying ability, the drying step can be considerably shortened, and, at the same time, space may be more effectively utilized.

(2) Since normally coated areas of film are pre-dried by air drying, the microwave energy is selectively absorbed only in the thickly coated areas of the film, as a consequence of which the thickly coated areas of the film can be dried without lowering the quality of the coating resulting from quick drying.

(3) Since quick drying of the thickly coated areas of the film extensively enhances the drying ability, recent demands in the art are met, that is, increased coating velocity can be obtained.

While not to be construed as limitative, the microwave drying in accordance with the present invention will, on an industrial scale, generally be completed in about 3 to about 30 seconds, even more preferably 3 to 15 seconds, and most preferably within 3 to 10 seconds. When the time is too short, product quality problems easily arise since input power must be increased. On the other hand, when the time is too long, quality problems do not arise but excessively large size equipment is required.

On a commercial scale, the input power for the microwave drying is not substantially limited in any fashion. However, efficiency is somewhat decreased when input power is too large, and, ordinarily, for best results, an input power of about 3 to about 30 kw, even more preferably 5 to 20 kw, will be used.

Web travel rates are not limited, but the faster, the better in view of efficiency. Since, web travel rates, however, are practically limited by the coating speed available, on a commercial scale, web travel rates of about 20 to 300 m/min will be used.

It should clearly be understood that in accordance with the present invention there is no limitation on the type of silver halide photographic materials which can be processed, i.e., any type of silver halide per se, any type of hydrophilic colloid binder as is conventionally used in the art and any type of moisture content as is conventionally used in the art can be processed with ease. Examples of useful silver halides are silver chloride, silver bromide, silver iodide, silver bromoidide, silver iodobromochloride or mixtures thereof.

Further, in accordance with the present invention, cool-setting conditions as are typically used in the art can be used in accordance with the present invention. This is not overly important to the present invention, but usually cool-setting is at a temperature of from about 0° to about 10° C., even more conventionally 2° to 5° C., by blowing air on the element at a dewpoint of −10° to 5° C., even more conventionally −10° to 0° C.

With most commercial scale operations, the velocity of the blowing air to achieve the cooling and setting is on the order of 2to 10 m/sec, even more usually 2 to 5 m/sec. In a similar fashion, the humidifying conditions for the silver halide materials processable in accordance with the present invention are merely selected from those conventionally used in the art. Usually, temperatures on the order of about 15° to 40° C., more generally 20° to 25° C., are used in combination with air in a relative humidity of about 50 to about 75%, more generally 55 to 70%.

To more clarify the effects afforded by the invention, a comparison example and a working example are given below.

COMPARISON EXAMPLE

A silver halide emulsion as shown in Table 1 was coated in a single layer in an amount of 98 cc/m$^2$ in the undried condition on a polyethylene terephthalate film 30 cm wide conveyed at a velocity of 50 m/min by the coating method disclosed in Japanese Patent Publication 12390/1970, and the aforesaid layer was passed along a straight line through a drier which comprises an air impinging plate having a plurality of holes 216 m long while supporting the uncoated side of the film to dry the coated film. The drying conditions are given in Table 2.

TABLE 1

| | |
|---|---|
| Gelatin concentration | 5.0 wt% |
| Silver halide | 5 wt% |
| Viscosity | 30 cp |
| Specific gravity | 1.09 |
| Surface tension | 42.0 dyne/cm |

TABLE 2

| | |
|---|---|
| Dry bulb temperature | 28° C. |
| Wet bulb temperature | 18° C. |
| Air velocity | 20 m/sec |

The thickly coated areas in various portions were measured to obtain their maximum values as given in Table 3 below.

TABLE 3

| | |
|---|---|
| Coat-start areas | Normal areas* × 2.0 |
| Lug areas | Normal areas* × 1.3 |
| Joined areas | Normal areas* × 1.8 |

*The thickness of the normal areas was 98 μ (wet state).

As a result, it was found that the normally coated areas of the film were completely dried at a point 153.6 m from the inlet of the drier, whereas the thickly coated areas of the film in the coat-start areas, where the material was heavily coated, were dried at the outlet of the drier, resulting in difficulties in further increasing the coating velocity.

EXAMPLE

The comparison example described above was repeated except that the conveying velocity or coating velocity of the polyethylene terephthalate film was increased to 65 m/min, and an oven type microwave drier having a length of 4.8 m with a slit through which the film passed was installed at the outlet of the air drying apparatus, after which coating and drying were carried out. As is well known in the art, an oven type microwave drier essentially comprises a box having slits running in a horizontal direction disposed at two sides thereof, the travelling web being passed through the slits. The microwave generator is disposed above the travelling web so as to impinge microwaves thereon. In this particular instance, the inlet and outlets had a slit width of 20 mm. To serve as a power source for the microwave drier, three units each having a frequency of 2,450 MHz and an output 4.5 kw were installed, and power was supplied by a waveguide through an isolator in a conventional manner.

As a result, it was found that the normally coated areas of the film were dried completely at a point 211.2 m from the inlet of the drier, whereas the thickly coated areas of the film were supplied in the undried condition from the air drying apparatus to the microwave drier. The undried thickly coated areas of the film were completely dried by the microwave drier without contaminating the humidifying step.

It was found in the insepction of the photographic quality of the normally coated areas of the film after drying that the quality therefor was identical with that of the preceding comparison example and that lowering in quality due to quick drying was not present.

While the invention has been described in detail and with reference to specific embodiments thereof, it will be apparent to one skilled in the art that various changes and modifications can be made therein without departing from the spirit and scope thereof.

What is claimed is:

1. In a method of making silver halide photographic light-sensitive materials by coating a continuously travelling web with at least one silver halide emulsion and cooling, setting, drying and humidifying the same, wherein said web is coated with areas of the desired thickness and areas of a thickness greater than the desired thickness, improvement which comprises, after said coated film is cooled and set, drying said desired thickness areas by a drying method other than the application of microwaves, and then drying undried areas of a thickness greater than the desired thickness by the application of microwaves.

2. The method of claim 1, wherein said areas of a thickness greather than said desired thickness areas have a thickness of from about 120% to about 300% that of the desired thickness.

3. The method of claim 1, wherein the initial drying is accomplished by blowing air against said coated film.

4. The method of claim 1, wherein said microwave drying is accomplished within about 3 to about 30 seconds.

5. The method of claim 1, wherein said web is travelling at a rate of from 20 to about 200 m/min.

* * * * *